US010067459B2

(12) United States Patent
Tokumoto

(10) Patent No.: US 10,067,459 B2
(45) Date of Patent: Sep. 4, 2018

(54) IMAGE FORMING APPARATUS

(71) Applicant: CANON KABUSHIKI KAISHA, Tokyo (JP)

(72) Inventor: Masayuki Tokumoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/718,272

(22) Filed: Sep. 28, 2017

(65) Prior Publication Data

US 2018/0101122 A1 Apr. 12, 2018

(30) Foreign Application Priority Data

Oct. 11, 2016 (JP) ..... 2016-199928

(51) Int. Cl.
*G03G 15/00* (2006.01)
*G03G 21/16* (2006.01)

(52) U.S. Cl.
CPC ..... *G03G 21/1604* (2013.01); *G03G 15/5016* (2013.01)

(58) Field of Classification Search
CPC . G03G 15/5016; G03G 21/16; G03G 21/1604
See application file for complete search history.

(56) References Cited

U.S. PATENT DOCUMENTS 7,062,197 B2 * 6/2006 Kunugi ..... G03G 15/5016 399/107
8,934,802 B2 * 1/2015 Koyanagi ..... B41J 13/14 399/81

FOREIGN PATENT DOCUMENTS

JP 2012-234102 A 11/2012
JP 2013-070279 A 4/2013

OTHER PUBLICATIONS

Copending, unpublished U.S. Appl. No. 15/599,536, filed May 19, 2017.

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes a main assembly, an operating portion provided slidably between a first position and a second position of the main assembly, a supporting position, a slide rail, a slidable member, and an urging unit. A relationship of engagement between the slide rail and the slidable member is set so that the engagement between the slide rail and the slidable member when the operating portion is in a position between the first position and the second position is looser than the engagement between the slide rail and the slidable member when the operating portion is in the first position or the second position.

6 Claims, 9 Drawing Sheets

IMAGE FORMING APPARATUS

FIELD OF THE INVENTION AND RELATED ART

The present invention relates to an image forming apparatus including an operating portion and having functions of a copying machine, a printer and a facsimile machine in combination.

In recent years, the image forming apparatus has been designed in a vertical type in which the image forming apparatus is made compact in planer size so as not to occupy a large space even in an office environment, and also a sheet discharge tray is not provided on a side surface of a main assembly of the image forming apparatus but an in-body discharge type has become mainstream. In such an image forming apparatus, a liquid crystal display used as an operating panel is made a small type, so that viewability of recording paper (sheet) which is in-body-discharged is improved.

On the other hand, as regards the image forming apparatus in recent years, complication and multifunctionality progress, and correspondingly an operating portion increases in size, so that usability is improved by using a wide size in a liquid crystal display area. Particularly, in the fields for consumers and offices, the wide size is used in many cases. In the case where the operating portion on which a wide-sized operating panel is mounted is attached to the image forming apparatus, such an arrangement that the operating portion hides (covers up) an in-body sheet discharge portion is assumed. In such a case, viewability of a discharged sheet becomes poor, so that a user (operator) does not notice discharge of the sheet or leaving behind of the sheet generates in some cases. In order to solve such problems, an image forming apparatus in which the operating portion is slid leftward and rightward has been proposed in Japanese Laid-Open Patent Application (JP-A) 2013-70279.

Further, in these days, as disclosed in JP-A 2012-234102, as an image forming apparatus adaptable to universal design, a constitution in which both of an operation by the user in a standing attitude in front of a main assembly of the image forming apparatus and an operation by a (physical) handicapped person in a sitting attitude can be easily performed has been proposed. That is, an image forming apparatus such that the operating portion projecting toward the front side of the main assembly is movable between a normal operation (use) position and a frontward pulling-out position and thus is slidable frontward and rearward, and the like image forming apparatus have been proposed. In order to suppress jerkiness (loosening) of the operating portion at a position width the operating portion is slid, the operating portion is movable through a groove portion while using, as a guiding portion, a projection provided in the main assembly side of the image forming apparatus. An outer diameter of the projection and a grooved dimension of the groove portion are set at an engagement dimension, so that a degree of the jerkiness of the operating portion itself is reduced.

The operating portion disclosed in JP-A 2012-234102 is slidable forward and rearward, but in order to suppress the jerkiness of the operating portion itself, the following constitution is employed. That is, a constitution such that the projection provided in the main assembly side of the image forming apparatus is used as the guiding portion and the operating portion is movable through the groove portion is employed, and an engagement dimension relationship is established between the outer diameter of the projection and the groove dimension of the groove portion.

However, by establishing the engagement dimension relationship between the projection and the groove portion, the jerkiness of the operating portion was suppressed, but on the other hand, an operating force of a sliding operation increased. Such a problem arose.

SUMMARY OF THE INVENTION

According to an aspect of the present invention, there is provided an image forming apparatus comprising: a main assembly; an operating portion provided slidably between a first position and a second position of the main assembly; a supporting position configured to slidably support the operating portion; a slide rail provided on one of the supporting portion and the operating portion along a sliding direction of the operating portion and configured to slidably support the operating portion; a slidable member provided on the other one of the supporting portion and the operating portion so as to be engageable with the slide rail and configured to be slidable with the slide rail; and an urging unit configured to urge the operating portion toward the first position when the operating portion is in a position closer to the first position than a predetermined position between the first position and the second position is and configured to urge the operating portion toward the second position when the operating portion is in a position closer to the second position than the predetermined position is, wherein a relationship of engagement between the slide rail and the slidable member is set so that the engagement between the slide rail and the slidable member when the operating portion is in a position between the first position and the second position is looser than the engagement between the slide rail and the slidable member when the operating portion is in the first position or the second position.

Figure 8:
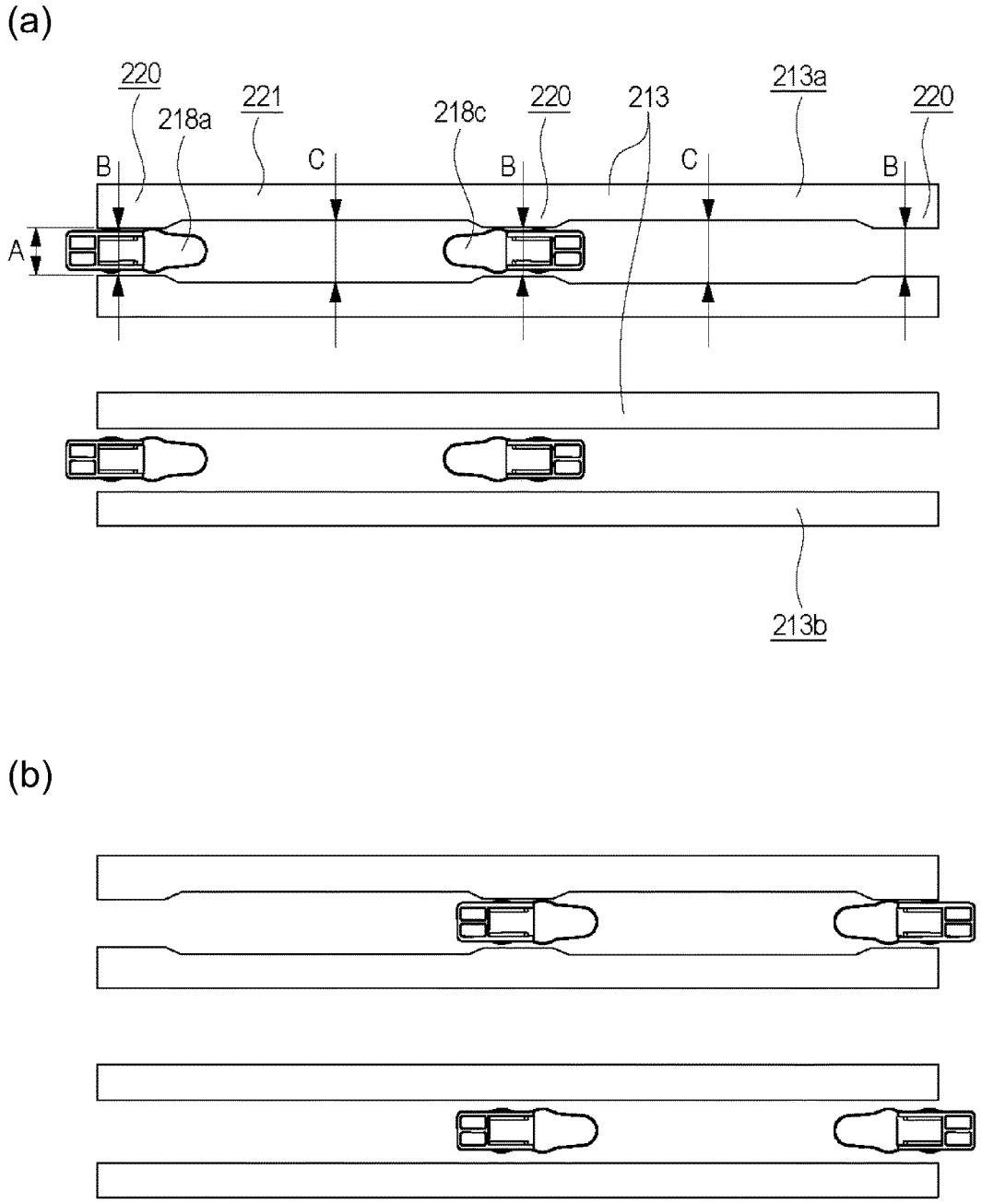

Parts (a) and (b) of FIG. 8 are schematic views for illustrating a positional relationship between the slide rail and the slidable member.

Figure 9:
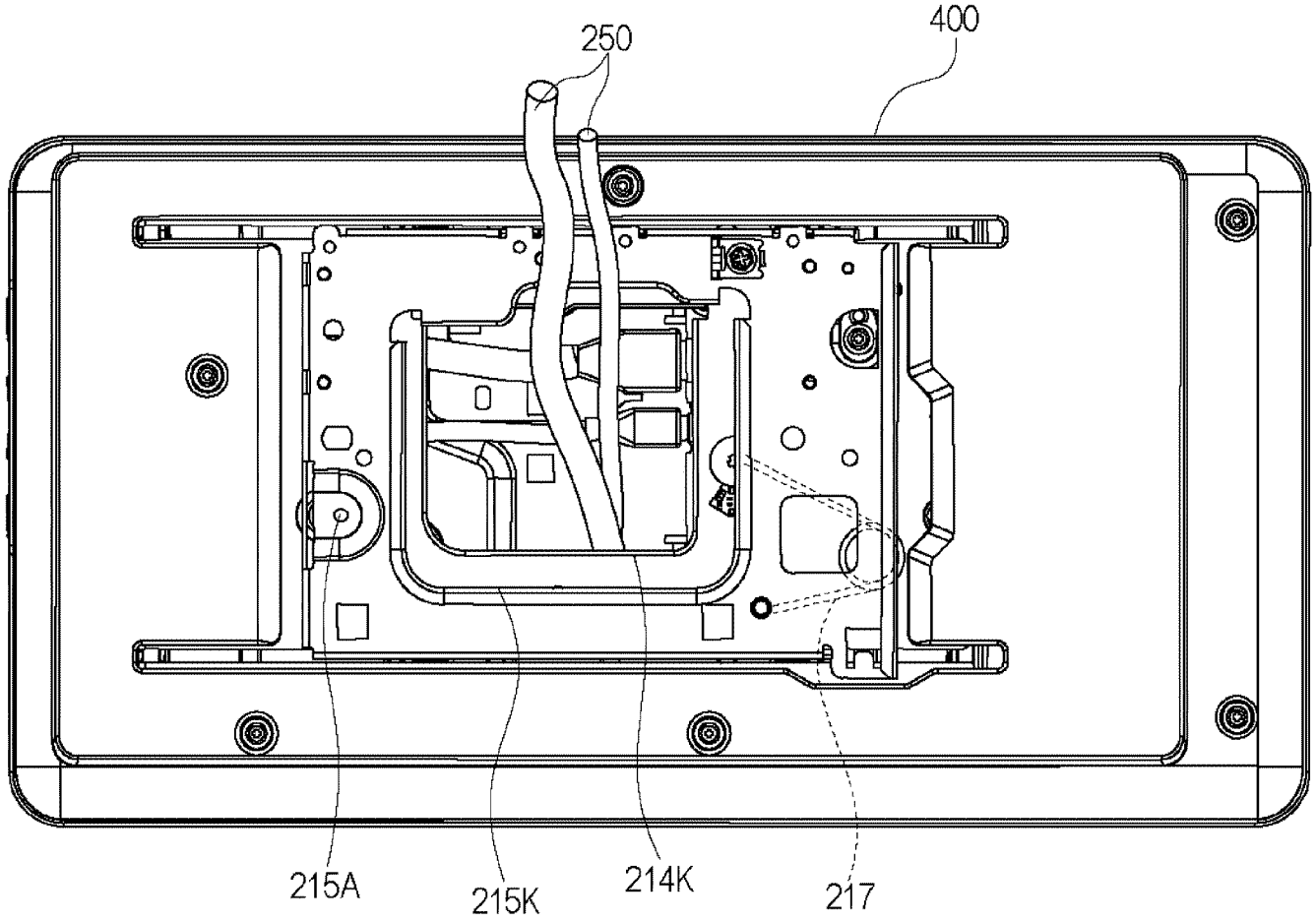

FIG. 9 is a schematic view for illustrating a positional relationship of elements of the operating portion during maintenance.

DESCRIPTION OF EMBODIMENTS

Embodiments of an image forming apparatus according to the present invention will be described with reference to the drawings.

Figure 1:
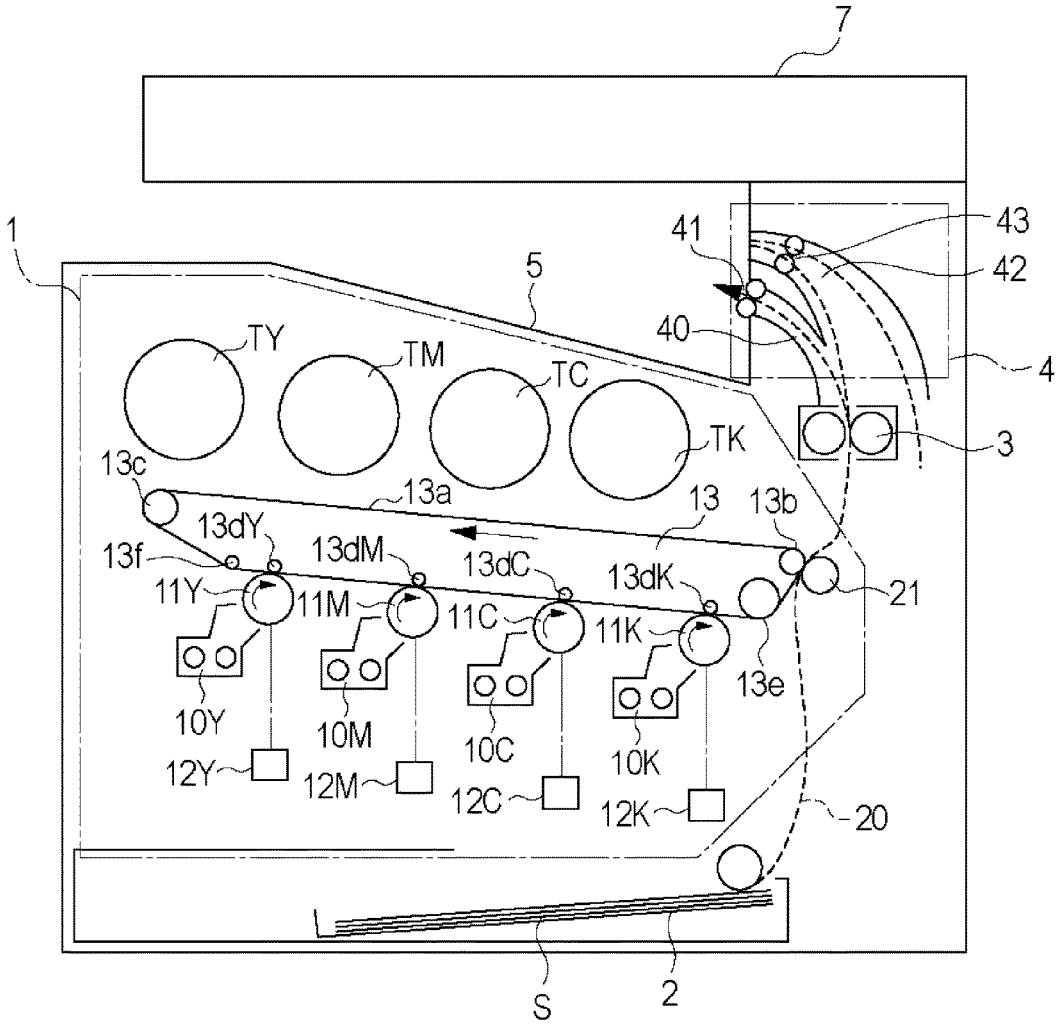
FIG. 1 is a sectional view of an image forming apparatus in an Embodiment.
Figure 2:
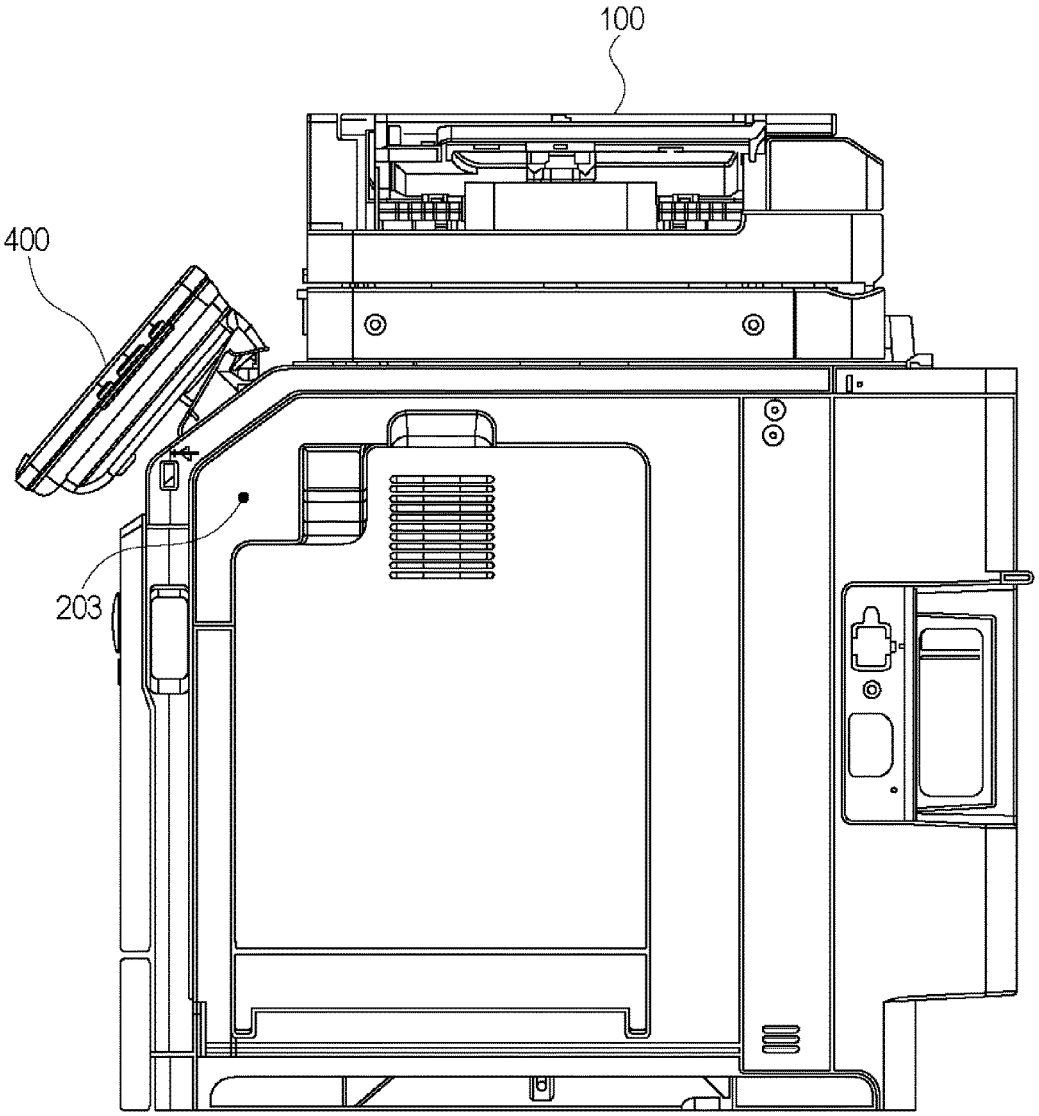
FIG. 2 is a side view of the image forming apparatus in the Embodiment.

FIG. 1 is a sectional view of a main assembly of a full-color laser copying machine (image forming apparatus) in an Embodiment of the present invention. The main assembly of the copying machine includes an image forming portion 1 for forming a toner image, a sheet feeding device 2 for feeding a sheet S to the image forming portion 1, and a fixing device 3 constituting a fixing portion. The main assembly further includes a fresh toner storing portions T (TY, TM, TC, TK) for storing fresh toners of four colors, a sheet discharge portion 4 for feeding and discharging the sheet S after fixing, a sheet stacking portion 5 for stacking the discharged sheet S, and an original reading device 7 for reading an original.

The image forming portion 1 is of a four-drum full-color type, and includes four process cartridges 10 (10Y, 10M, 10C, 10K) for forming toner images of the four colors of yellow (Y), magenta (M), cyan (C) and black (K), which are detachably mountable to the main assembly of the copying machine (image forming apparatus). The process cartridges 11 include photosensitive drums 11 (11Y, 11M, 11C, 11K), respectively. The image forming portion 1 further includes unshown charging units for electrically charging the photosensitive drums 11 under application of a predetermined voltage, unshown developing devices for developing latent images, formed on the photosensitive drums 11, with the toners, and unshown cleaning units for removing the toners which are not completely transferred from the photosensitive drums 11. In addition, the image forming portion 1 includes laser scanners 12 (12Y, 12M, 12C, 12K) provided below the process cartridges 10 so as to form (draw) the latent images on the photosensitive drums 11, and an intermediary transfer unit 13 provided on the process cartridge 10.

The intermediary transfer unit 13 includes an intermediary transfer belt 13*a*, a driving roller 13*b* and a tension roller 13*c*. The intermediary transfer unit 13 further includes primary transfer rollers 13*d* (13*d*Y, 13*d*M, 13*d*C, 13*d*K) and idler rollers 13*e* and 13*f*.

The intermediary transfer belt 13*a* is constituted by a film-shaped member and is rotated in an arrow direction by a driving force of the driving roller 13*b*. A predetermined transfer bias is applied by the primary transfer rollers 13*d*, whereby the respective color toner images on the photosensitive drums 11 are successively transferred onto the intermediary transfer belt 13*a* in a multiple transfer manner, so that a full-color toner image is formed.

On the other hand, the sheet S is fed by the sheet feeding device 2 and then is fed through a sheet feeding path 20. The sheet S is sent to a secondary transfer portion constituted by a nip between a secondary transfer outer roller 21 and the driving roller 13*b*, and onto the sheet S, the full-color toner image is transferred from the intermediary transfer belt 13*a*. The sheet S on which the full-color toner image is transferred is fed by the driving force of the driving roller 13*b* and is sent to the fixing device 3.

Above the fixing device 3, the sheet discharge portion 4 is disposed. The sheet discharge portion 4 includes a sheet discharging path 40, a sheet discharging roller pair 41, a reversing path 42 for double-side printing (copying), and a reversing roller pair 43. The sheet S discharged from the sheet discharge portion 4 is stacked on the sheet stacking portion 5.

Next, an image forming operation of the image forming apparatus (copying machine) having the above-described constitution will be described.

First, the original is set on the original reading device 7, and a mode for copying is inputted to an operating panel (not shown) and then a start button is pressed. An image read by the original reading device 7 is sent to an unshown control device and is stored as image information.

In the image forming portion 1, each of surfaces of the photosensitive drums 11 is electrically charged uniformly to a predetermined polarity and a predetermined potential by the unshown (associated) charging unit. Thereafter, the surface of the photosensitive drum 11 is scanned with laser light emitted from the laser scanner 12 on the basis of the image information stored in the control device, so that the surfaces of the photosensitive drums 11 are successively exposed to the laser light and thus electrostatic latent images are formed on the surfaces of the photosensitive drums 11. Thereafter, the electrostatic latent images are developed with the toners into the toner images by the unshown developing units into which the fresh toners are supplied from the fresh toner storing portions T.

Then, with rotations of the photosensitive drums 11, the toner images are transferred onto the intermediary transfer belt 13*a* by a primary transfer bias applied to the primary transfer rollers 13*d* which form primary transfer portions as contact portions with the intermediary transfer belt 13*a*. The above-described operation is successively performed for each of the four process cartridges 10, so that the toner images are transferred from the photosensitive drums 11 onto the intermediary transfer belt 13*a* in the multiple-transfer manner and thus the full-color image is formed on the intermediary transfer belt 13*a*.

On the other hand, in parallel to the toner image forming operation described above, the sheet S is fed by the sheet feeding device 2 and is fed along the sheet feeding path 20. The sheet S is subjected to not only oblique movement correction but also positional alignment with the toner image on the intermediary transfer belt 13*a* by an unshown registration roller pair provided in the sheet feeding path 20. After the positional alignment, the sheet S is set to the secondary transfer portion constituted by the nip between the secondary transfer outer roller 21 and the driving roller 13*b*.

At the secondary transfer portion, by a secondary transfer bias applied to the secondary transfer roller 21, the toner image is transferred from the intermediary transfer belt 13*a* onto the sheet S. Thereafter, the sheet S is fed by the driving force of the driving roller 13*b* and is sent to the fixing device 3.

The sheet S sent to the fixing device 3 is heated and pressed by the fixing device 3, so that the respective color toners are melted and thus the toner images are fixed as a full-color visible image on the sheet S. Thereafter, the sheet S on which the image is fixed is sent to the sheet discharge portion 4 provided downstream of the fixing device 3 and passes through the sheet discharging path 40, so that the sheet S is discharged by the sheet discharging roller pair 41 and is stacked on the sheet stacking portion 5 with a downward image surface thereof.

<Structure of Operating Portion and Image Forming Apparatus in this Embodiment>

Figure 3:
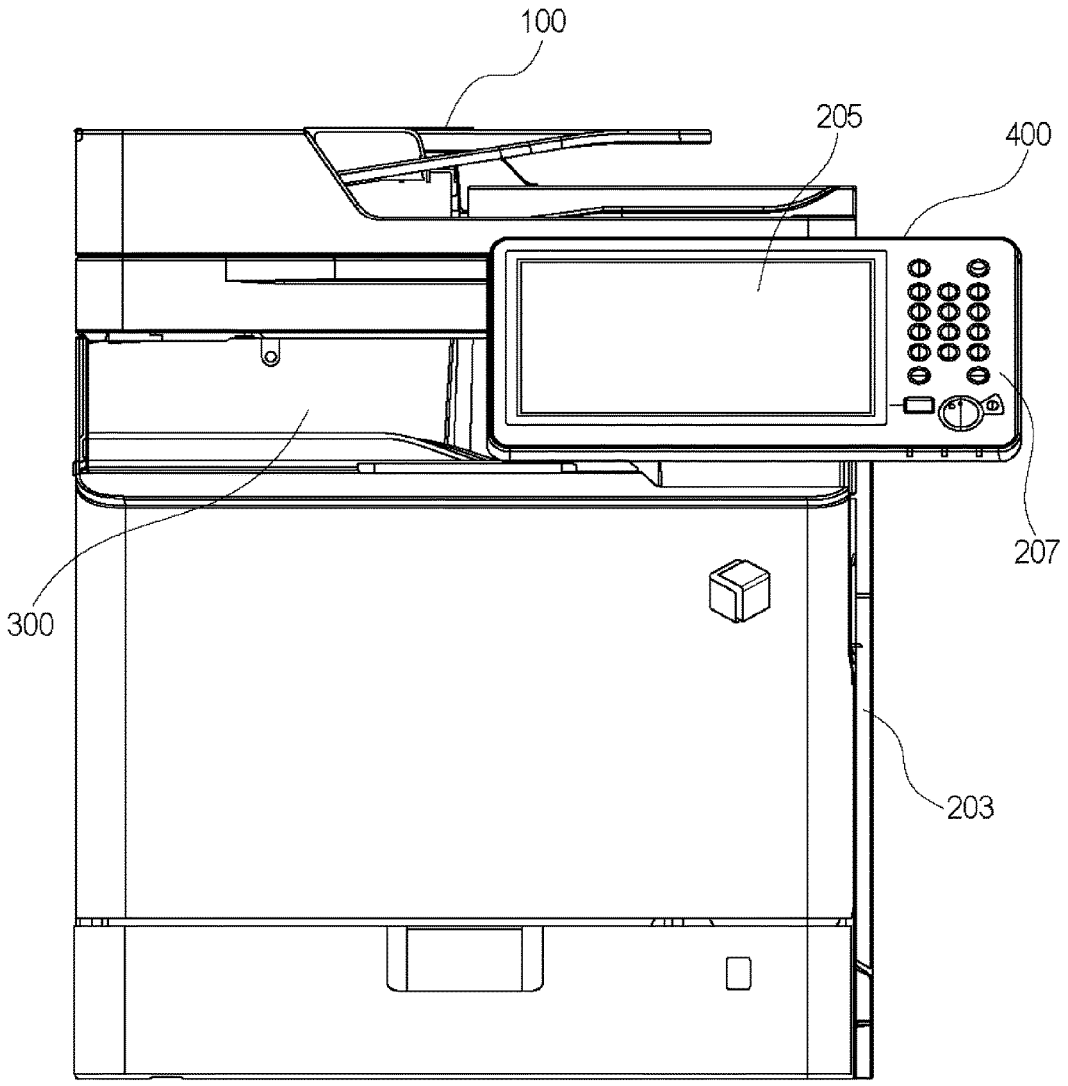
FIG. 3 is a front view of the image forming apparatus in the case where an operating portion is in a first position.
Figure 4:
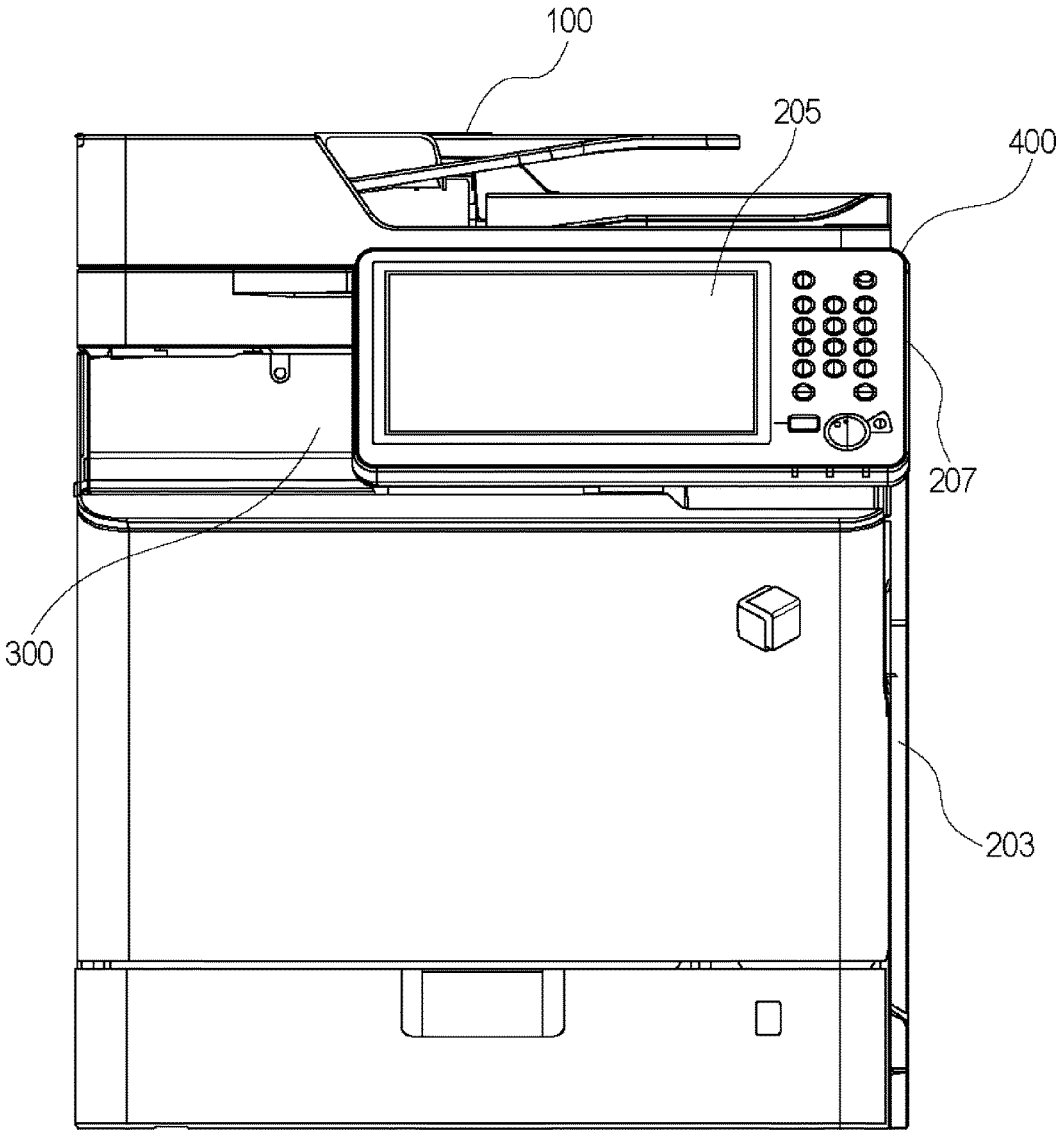
FIG. 4 is a front view of the image forming apparatus in the case where the operating portion is in a second position.
Figure 5:
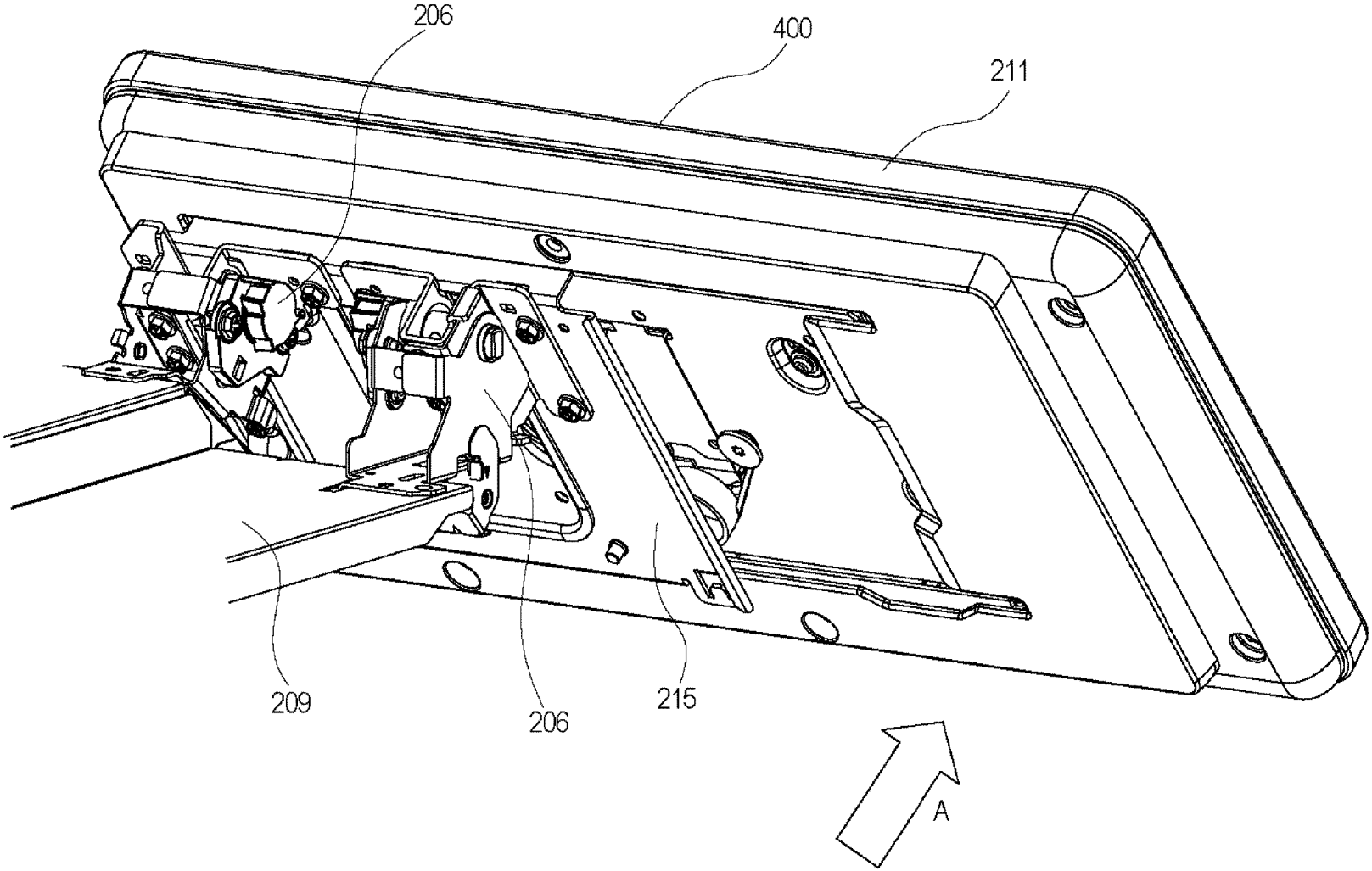
FIG. 5 is a perspective view of the operating portion as seen from a rear side in a state in which a rear cover is removed.

Structures of the operating portion and the image forming apparatus in this embodiment will be described with reference to FIGS. 2 to 6. First, the structure of an image forming apparatus 100 provided with an operating portion 400 in this embodiment will be described. In the image forming apparatus 100 in which the sheet on which the image is formed and which is outputted is discharged on an in-body discharge portion 300, as shown in FIG. 5, the operating portion 400 is fixedly to a frame 209 of the image forming apparatus 100 by fastening with crews through hinge portions 206. Further, the image forming apparatus 100 is provided with a door 203 openable for removing the fed sheet in the case where the fed sheet on which the image is formed stops in a feeding path. In this embodiment, the door 203 is disposed in a right-hand side as seen from a front surface side of the image forming apparatus 100, but the door 203 may also be similarly disposed in a left-hand side. The image forming apparatus 100 in this embodiment is provided with the operating portion 400 having the same surface width a large-sized display portion 205 and a button portion 207 are provided in combination as shown in FIG. 3, and is capable of outputting an A4-sized sheet at the maximum. In this case, when priority is given to viewability of the in-body discharge portion 300, the operating portion 400 is slidably provided so that a predetermined minimum sheet stacked on the sheet discharge portion 300 is not hidden by the operating portion 400. In this case, the operating portion 400 projects from a surface of the door 203 provided on the image forming apparatus 100. On the other hand, priority is given to an operating property such that the door 203 provided on the image forming apparatus 100 is opened and closed, as shown in FIG. 4, the operating portion 400 is constituted so as to be slidable to a position inside the surface of the door 203 of the image forming apparatus 100. Thus, in this embodiment, a constitution capable of compatibly realizing the viewability of the in-body sheet discharge portion and the operating property when the door 203 is opened and closed is employed. Further, a constitution in which the operating portion 400 is slid in a substantially horizontal direction relative to the image forming apparatus 100 so that the operating portion 400 can be at rest at respective positions.

The respective positions of the operating portion 400 in this embodiment will be described. The operating portion 400 is, as described above, movable to two positions consisting of a position where access to the door 203 is not prevented when a removing operation of the fed sheet is performed and a position width priority is given to the viewability of the fed sheet discharged on the in-body sheet discharge portion. As shown in FIG. 3, a state (position) in which priority is given to the viewability of the in-body sheet discharge portion 300 and the operating portion 400 projects from the surface of the door 203 is defined as a first position. Further, as shown in FIG. 4, a state (position) in which the operating portion 400 is disposed inside the surface of the door 203 of the image forming apparatus 100 when priority is given to the operating property of the door 203 is defined as a second position. An operator (user) performs a sliding operation such that the operating portion is slid from left to right or right to left depending on respective situations such as opening/closing of the right-hand door, taking-out of the discharged sheet and the like.

<Sliding Constitution of Operating Portion>

Figure 6:
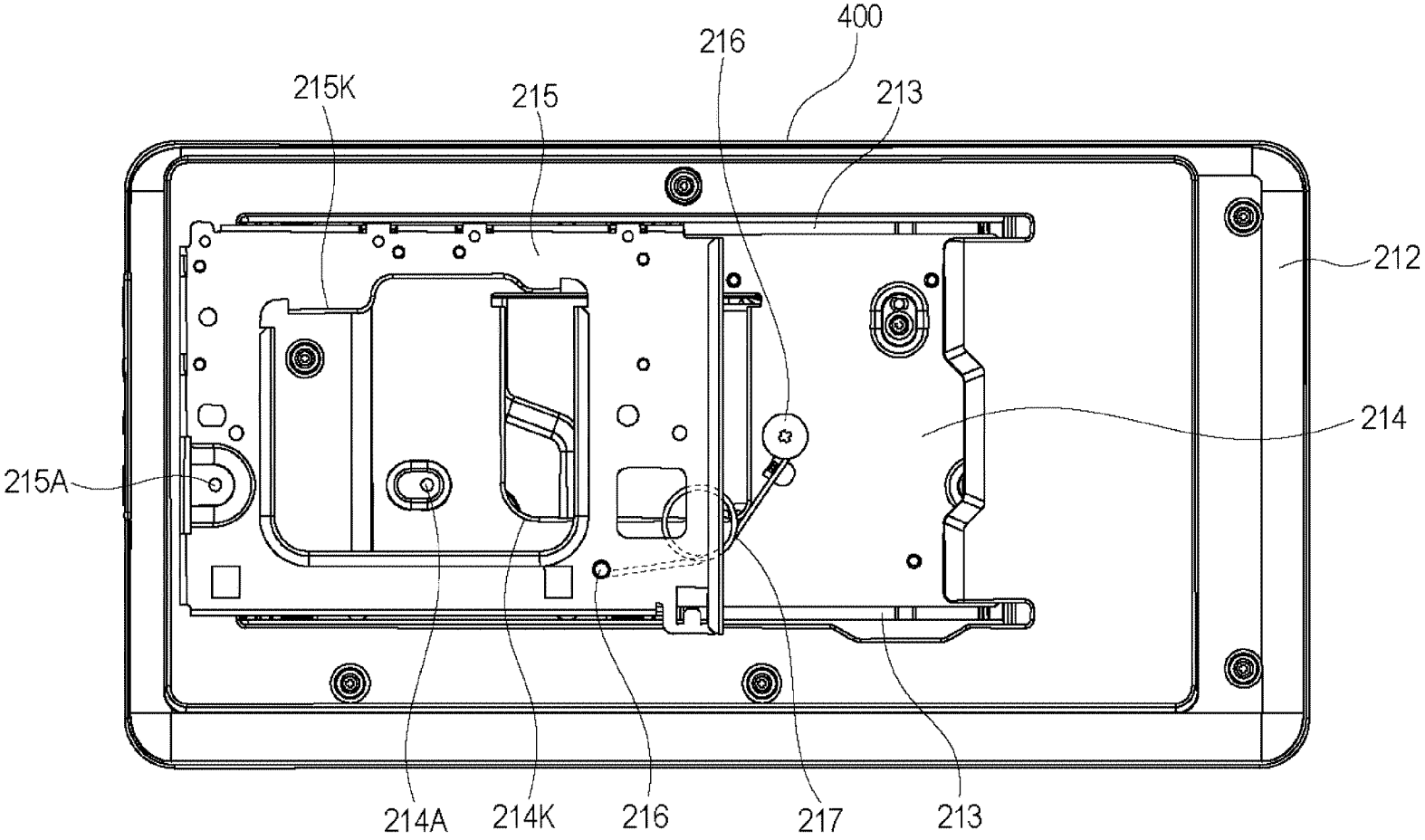
FIG. 6 is a rear view of the operating portion as seen in an arrow A direction in FIG. 5.

A sliding constitution of the operating portion 400 in this embodiment will be described with reference to FIGS. 5 and 6. FIG. 5 is a perspective view of the operating portion 400, from which a rear cover is removed, fixed to the frame 209 of the image forming apparatus 100 by fastening. FIG. 6 is a rear view of the operating portion 400, from which the hinge portions 206 are removed, as seen in an arrow A direction of FIG. 5.

The operating portion 400 includes an operating panel unit 211. The operating panel unit 211 includes an operating panel portion 212 including the display portion 205, the button portion 207 and an unshown substrate. Further, the operating portion 400 further includes a rail portion 214 including slide rails 213, for constituting a sliding mechanism, extending substantially parallel to a longitudinal direction of the operating panel portion 212. The operating panel portion 212 and the rail portion 214 are fastened with screws.

A slide frame unit 215 is a supporting portion for slidably supporting the operating portion 400. The slide frame unit 214 is fixed to the main assembly of the image forming apparatus through the hinge portions 206.

The slide frame unit 215 includes slidable members 218 each paired with the rail portion 214 and slidable on the slide rails 213. The slidable members 218 slide on the slide rails 213, so that the operating portion 400 is slidably supported. Further, to the slide frame unit 215, the hinge portions 206 are fastened, and the hinge portions 206 are fastened to the frame 209 with screws. Further, the rail portion 214 and the slide frame unit 215 are paired with each other through the slidable members 218, but between these members 214 and 215, a torsion spring 217 as an urging unit is mounted. Both end portions of an arm of the torsion spring 217 are processed in a circular shape, and inner peripheral surfaces of the circular-shaped portions are fastened to the rail portion 214 and the slide frame unit 15 with stepped screws 216. The torsion spring 217 is rotatable about a center portion of a circular-shaped portion of the arm thereof.

In this embodiment, a constitution in which the slide rails 213 are provided in the operating panel unit 211 side and the slidable members 218 slidable on the slide rails 213 are provided in the slide frame unit 215 side was employed. However, a constitution in which the slidable members 218 are provided in the operating panel unit 211 side and the slide rails 213 are provided in the slide frame unit 215 side may also be employed.

The torsion spring 217 is fastened to the rail portion 214 and the slide frame unit 215 with the stepped screws 216. Further the torsion spring 217 is mounted for pulling from an original rest position toward the other rest position when the operating panel portion 212 is slid, so that an operating force when the operator slides the operating panel portion 212 is assisted.

Further, by the action of the torsion spring 217, the operating portion 400 is capable of stopping at only the first and second positions, so that a constitution in which the operating portion 400 cannot stop at an intermediary position between the first and second positions, i.e., cannot stop during a so-called sliding operation. That is, when the operating portion 400 is in a position closer to the first position than a predetermined position between the first and second positions is, the operating portion 400 is urged toward the first position by the torsion spring 217. Further, when the operating portion 400 is in a position closer to the second position than the predetermined position is, the operating portion 400 is urged toward the second position by the torsion spring 217.

<Constitution of Slide Rail Portion>

Figure 7:
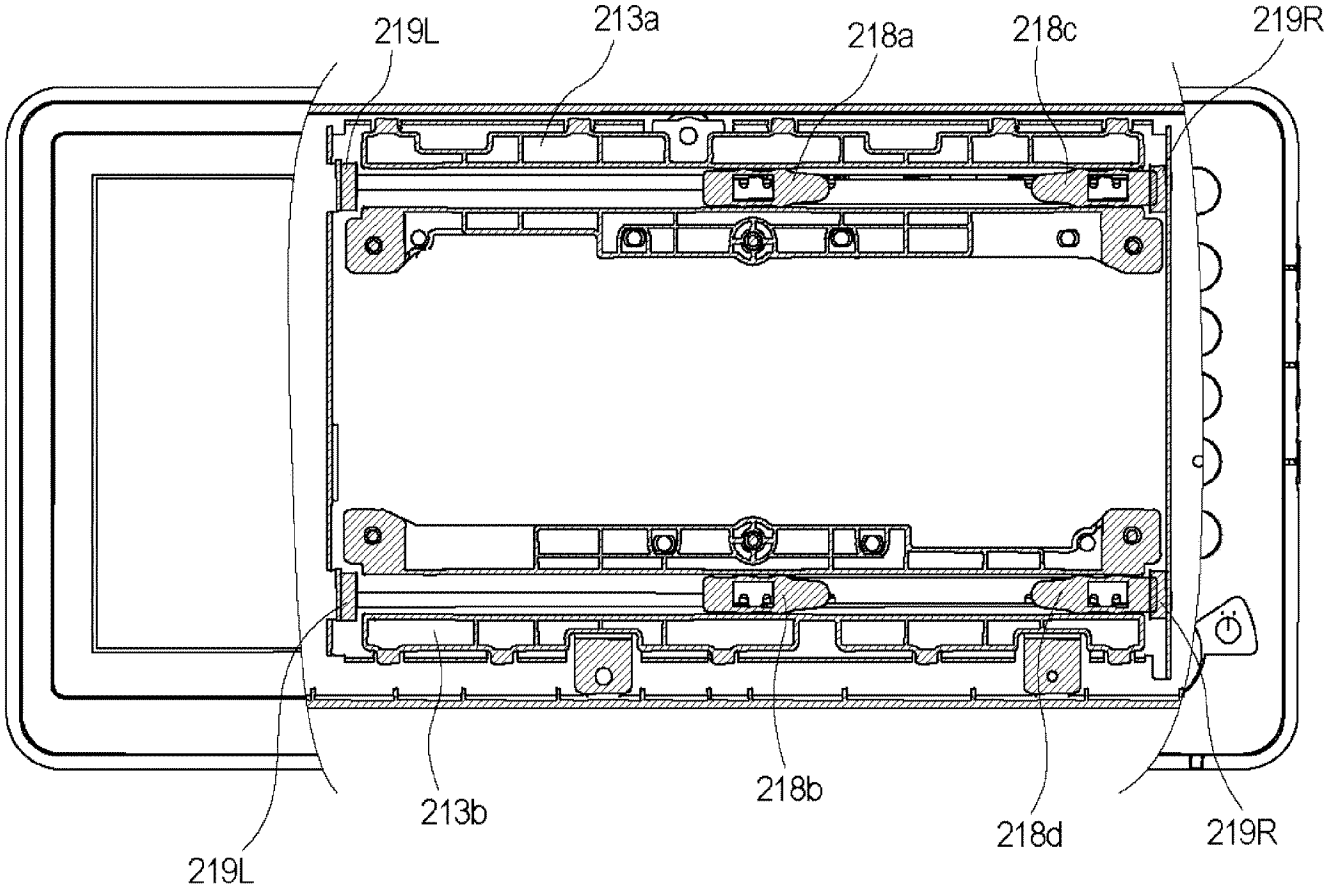
FIG. 7 is a schematic view of the operating portion as seen from a front surface side when the operating portion is in the second position, and includes a partially cut cross section at a position width a slide rail and a slidable member are in sight.

FIG. 7 is a front view of the operating portion 400 when the operating portion 400 is in the second position, and includes a partially cut cross section at a position where the slide rails 213 and the slidable members 218 are in sight. The rail portion 214 is provided with two upper and lower pairs of slide rails disposed substantially in parallel to a sliding direction of the operating portion 400. That is, the slide rails 213 include a first slide rail pair 213*a* for slidably supporting the operating portion 400. Further, the slide rails 213 include a second slide rail pair 213*b*, provided in parallel to the first slide rail pair 213*a*, for slidably supporting the operating portion 400. The slide frame unit 215 is provided with the slidable members 218 (218*a* to 218*d*). The slidable members 218 engage with the slide rails 213 and slide on the slide rails 213, so that the operating portion 400 is slidable. In this embodiment the slidable members 218 include the slidable members 218*a* and 218*c* constituted slidably in engagement with the first slide rail pair 213*a*. The slidable members 218*a* and 218*c* are disposed at spaced positions from each other with respect to the sliding direction of the operating portion 400.

Further, in this embodiment, the slidable members 218 include the slidable members 218*b* and 218*d* constituted slidably in engagement with the second slide rail pair 213*b*. The slidable members 218*v* and 218*d* are disposed at spaced positions from each other with respect to the sliding direction of the operating portion 400.

At both end portions of each of the first and second slide rail pairs 213*a* and 213*b*, position regulating members 219 are provided, so that positions where the slidable members 218 abut against the position regulating members 219 are rest positions which are left and right slide positions. Each of positions where of the slidable members 218, the two slidable members 218*a* and the 218*b* which are disposed in the left-hand side abut against the position regulating members 219L disposed at the left end portions of the first and second slide rail pairs 213*a* and 213*b* is the first position. Further, each of positions where the right-hand side two slidable members 218*c* and 218*d* abut against the position regulating members 219R is the second position.

parts (a) and (b) of FIG. 8 are schematic views each showing a positional relationship between the slide rails and the slidable members. Of the slide rails 213, a width (B) at left and right end portions and a central portion are substantially in an engagement state with a width (A) of the slidable members 218 since a slide rail width is narrow. In this embodiment, the engagement state means that a dimensional difference between the rail width of the slide rails 213 and the width of the slidable members 218 is 0.2 mm or less.

On the other hand, a width (C) at portions other than the left and right end portions and the central portion is sufficiently wider than the slidable member width (A). In the case of this embodiment, with respect to a direction perpendicular to the sliding direction of the operating portion 400, the width (A) of the slidable members 218 is 10.2 mm, the width (B) which is the rail width of the slide rails 213 is 10.3 mm, and the width (C) is 10.7 mm which is sufficiently wider than the width (A). Further, a full length of each slide rail 213 is 207 mm, of which a length at each of the left and right end portions and the central portion of the slide rails which are substantially in the above-described engagement state with the slidable members is 20 mm.

Therefore, in the case where the operating portion 400 is in the first position, the slidable members 218*a* and 218*c* are positioned at the left end portion and the central portion, respectively, in the slide rail pair 213*a*, and the slidable members 218*a* and 218*c* and the slide rail pair 213*a* are in the engagement state, with the result that the operating portion 400 is in a state in which there is no jerkiness (part (a) of FIG. 8). In other words, the slide rail pair 213*a* includes, in the case where the operating portion 400 is in the first position or the second position, the first rail portions 220 (regions with the width (B)) as engaging portions width the slidable members 218 and the slide rails 213 engage with each other. Similarly, in the case where the operating portion 400 is in the second position, the slidable members are positioned at the right end portion and the central end portion, respectively, in the slide rail pair 213*a*, so that the operating portion 400 is in the state in which there is no jerkiness (part (b) of FIG. 8). At an intermediary position where the operating portion 400 is being slid from the first position to the second position, the slide rail width is sufficiently wider than the slidable member width, so that the operating portion 400 is in a state in which the jerkiness generates. In other words, in the case where the operating portion 400 is positioned between the first position and the second position, the slidable members 218 are constituted slidably with the second rail portions 221 of the slide rail pair. Further, an engagement relationship between the slidable members 218 and the second rail portions 221 is constituted so as to be looser than the engagement relationship the slidable members 218 and the first rail portions 220. Specifically, the rail width (C) of the second rail portions 221 is larger (wider) than the rail width (A) of the first rail portions 220.

In this embodiment, substantially in an entire region width the operating portion 400 is in the intermediary position where the operating portion 400 is being slid from the first position to the second position, the rail width of the slide rails 213 is the width (C), but is not limited thereto. For example, even at the intermediary position between the first position and the second position (between which the operating portion 400 is to be slid), a region width the rail width partly narrows (for example, a region with the width (B)) may also be formed. However, when a proportion of the region width the rail width narrows is high, an effect of reducing an operating force during the sliding of the operating portion 400 lowers. For this reason, a proportion of the second rail portions 221 (enlarged region with the width (C) as the rail width) to a full slide length (full length of the slide rails 213) of the operating portion 400 may preferably be at least 50% (50% or more), preferably 60% or more, further preferably 70% or more.

In this embodiment, in the enlarged region 221, a clearance between the slidable member 218 and the slide rail 213 may preferably be at least 0.3 mm (0.3 mm or more). However, when the clearance is excessively large, stopped portions in the slide rail pair increase, so that there is a liability that an operating property during the sliding of the operating portion 400 lowers. Therefore, the clearance between the slidable member 218 and the slide rail 213 in the enlarged region 221 may preferably be 2 mm or less at the maximum.

Further, in FIG. 8, of the two (upper and lower) pairs of slide rails 213, the upper slide rail pair 213*a* is in the engagement state between the slidable member width (A) and the width (B) at the above-described three portions consisting of the left and right end portions and the central portion. However, the lower slide rail pair 213*b* is in a relationship with the slidable members 218 (218*b*, 218*d*) such that the slide rail width is sufficiently wider than the slidable member width over an entire region. For this reason, the engagement relationship between the lower slide rail pair 213*b* and the slidable members 218 (218*b*, 218*d*) is looser than the engagement relationship between the upper slide rail pair 213*a* and the slidable members 218 (218*a*, 218*c*).

Further, in this embodiment, as shown in FIG. 8, with the first rail portion 220 disposed at the central portion of the slide rail pair 213*a*, both of the slidable member 218 a and the slidable member 218*c* engage. That is, when the operating portion 400 is in the first position (left-hand end), the slidable member 218*c* engages with the first rail portion 220 disposed at the central portion. Further, when the operating portion 400 is in the second position (right-hand end), the slidable member 218*a* engages with the first rail portion 220 disposed at the central portion. That is, the engaging portions of the slidable member 218*a* and the slidable member 218*c* at the central portion overlap with each other. Thus, the engaging portion (the first rail portion 220 at the central portion) can be made common to the slidable members 218*a* and 218*c*, and therefore, a proportion of the first rail portions 220 to the upper slide rail pair 213*a* can be lowered, so that the operating force of the operating portion 400 during the sliding can be lowered.

<Maintenance Operation of Operating Portion>

An operation method in the case where maintenance of the operating portion 400 is performed will be described with reference to FIGS. 6 and 9. In FIG. 6, the operating panel unit 211 includes the unshown substrate and is connected, through a cable 420, with the unshown control device disposed on the rear surface of the main assembly of the image forming apparatus. The operating portion 400 is constituted so as to be slidable leftward and rightward relative to the front surface of the main assembly, and therefore, a cable 250 only capable of leftward and rightward sliding of the operating portion 400 is accommodated in the operating portion 400. Specifically, the cable 250 connected with the substrate in the operating portion 400 passes through an opening 214K of the rail portion 214 and extends to an outside of the operating panel unit 211 through an opening 215K of the slide frame unit 215. The openings 214K and 215K coincide with each other at an intermediary position between the first position and the second position, i.e., at a so-called halfway position during the sliding.

In the case where the maintenance of the operating portion 400 is performed or in the case where the operating portion 400 is out of order and is required to be exchanged, or in the like case, there is a need to remove the cable, extending from the main assembly side, from the operating portion 400. As described above, the sliding operation can be stopped only at the first position or the second position by the action of the torsion spring 217. That is, the sliding operation cannot be stopped at the intermediary position between the first position and the second position, i.e., at the so-called halfway position during the sliding operation, and therefore, an operation for disconnecting the cable from the operating portion 400 is a very difficult operation.

Therefore, the slide frame unit 215 is provided with a hole 215A and the rail portion 214 is provided with a hole 215A, and at a position width the openings 214K and 215K coincide with each other during the sliding of the operating portion 400, also the holes 214A and 215A are disposed so as to coincide with each other. Therefore, as shown in FIG. 9, during the maintenance of the operating portion 400, the holes 214A and 215A are caused to coincide with each other, and then a screw or the like is inserted into the holes 214A and 215A. As a result, at the position where the holes 214A and 215A coincide with each other, the sliding opening of the slide frame unit 215 can be suppressed and thus the slide frame unit 215 can be fixed, so that the maintenance operation such as mounting and demounting of the cable can be easily carried out.

<Effect of the Present Invention>

By employing the constitution as described above, compared with the case where the slide rails are in the engagement state with the slidable members over an entire region thereof, a reduction in sliding resistance when the sliding operation is performed can be expected. As a result, it becomes possible to suppress that a force of the torsion spring increases more than necessary, with the result that an effect of lowering the sliding operating force is achieved. Further, the engagement state is formed only at minimum necessary positions of the slide rails, and therefore also abrasion of parts or the like can be suppressed.

In addition, the parts of the slide rails are not required to have high dimensional accuracy such that the slide rails engage with the slidable members in the entire region, so that improvement in processing property can be expected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-199928 filed on Oct. 11, 2016, which is hereby incorporated by reference herein in its entirety.

What is claimed is:

1. An image forming apparatus comprising:

a main assembly;

an operating portion provided slidably between a first position and a second position of said main assembly;

a supporting position configured to slidably support said operating portion;

a slide rail provided on one of said supporting portion and said operating portion along a sliding direction of said operating portion and configured to slidably support said operating portion;

a slidable member provided on the other one of said supporting portion and said operating portion so as to be engageable with said slide rail and configured to be slidable with said slide rail; and an urging unit configured to urge said operating portion toward the first position when said operating portion is in a position closer to the first position than a predetermined position between the first position and the second position is and configured to urge said operating portion toward the second position when said operating portion is in a position closer to the second position than the predetermined position is, wherein a relationship of engagement between said slide rail and said slidable member is set so that the engagement between said slide rail and said slidable member when said operating portion is in a position between the first position and the second position is looser than the engagement between said slide rail and said slidable member when said operating portion is in the first position or the second position.

2. An image forming apparatus according to claim 1, wherein said slidable member includes a first slidable member which is slidable in engagement with said slide rail and a second slidable member which is spaced from said first slidable member in the sliding direction and which is slidable in engagement with said slide rail, wherein said slide rail is disposed so that a region width said first slidable member engages with said slide rail when said operating portion is in the first position and a region width said second slidable member engages with said slide rail when said operating portion is in the second position overlap with each other.

3. An image forming apparatus according to claim 1, further comprising a regulating member provided at each of end portions of said slide rail with respect to the sliding direction of said operating portion and configured to regulate a position of said slidable member with respect to the sliding direction when said operating portion is in an associated one of the first position and the second position.

4. An image forming apparatus according to claim 1, further comprises, another slide rail provided on one of said supporting portion and said operating portion and configured to slidably support said operating portion, and another slidable member provided on the other one of said supporting portion and said operating portion and configured to be slidable with said another slide rail by being engaged with said another slide rail, wherein when said operating portion is at least in the first position or the second position, the relationship of engagement between said another slidable member and said another slide rail is looser than the relationship of engagement between said slidable member and said slide rail.

5. An image forming apparatus according to claim 1, wherein said slide rail includes a first rail portion width said slidable member and said slide rail engage with each other when the operating portion is in the first position or the second position and a second rail portion width said slidable member and said slide rail engage with each other when the operating portion is in the position between the first position and the second position, and wherein with respect to a direction perpendicular to the sliding direction, a difference in dimension between a rail width of said first rail portion and a width of said slidable member is 0.3 mm or less.

6. An image forming apparatus according to claim 1, wherein said slide rail includes a first rail portion width said slidable member and said slide rail engage with each other when the operating portion is in the first position or the second position and a second rail portion width said slidable member and said slide rail engage with each other when the operating portion is in the position between the first position and the second position, and wherein with respect to a direction perpendicular to the sliding direction, a difference in dimension between a rail width of said second rail portion and a width of said slidable member is 0.2 mm or more and 3 mm or less.

* * * * *